US005240406A

United States Patent [19]

Kanesaka

[11] Patent Number: 5,240,406

[45] Date of Patent: Aug. 31, 1993

[54] GAS HEATER

[76] Inventor: Ichiro Kanesaka, 7-3-1-1014, Hikarigaoka, Nerima-ku, Tokyo, Japan

[21] Appl. No.: 811,984

[22] Filed: Dec. 23, 1991

[30] Foreign Application Priority Data

Dec. 28, 1990 [JP] Japan ..... 2-415791

[51] Int. Cl.[5] ..... F23N 5/00

[52] U.S. Cl. ..... 431/66; 431/80; 431/255; 126/85 A; 237/3

[58] Field of Search ..... 431/66, 67, 73, 74, 431/28, 43, 80, 71, 72, 25, 255, 254; 126/85 A, 92 B, 85 R, 91 R; 237/3

[56] References Cited

U.S. PATENT DOCUMENTS

| | | | |
|---|---|---|---|
| 3,620,659 | 11/1971 | Fox | 431/66 |
| 3,663,150 | 5/1972 | Hapgood | 431/66 |
| 3,895,219 | 7/1975 | Richerson et al. | 431/66 X |
| 4,997,361 | 3/1991 | Geary | 431/66 X |

*Primary Examiner*—Larry Jones
*Attorney, Agent, or Firm*—Steven M. Rabin

[57] ABSTRACT

In a gas heater, a ceramic heater is used to ignite gas supplied to a gas burner. The ceramic heater is disposed in flame while the gas is burnt such that a change in the resistance value of the ceramic heater is sensed by a resistance value sensor to detect a flame extinction. Since the resistance value is varied between ceramic heaters, the deviation of the resistance value is compensated for depending on a reference value at a reference temperature of the ceramic heater so as to detect the flame extinction.

12 Claims, 5 Drawing Sheets

GAS HEATER

BACKGROUND OF THE INVENTION

1. Field of the Invention

The present invention relates to a gas heater, and in particular, to a gas heater of which ignition of gas is accomplished by a ceramic heater.

2. Description of the Prior Art

A gas heater has a high heating efficiency and a low requirement of fuel and hence has been applied to various kinds of heating applications. For example, in a heating operation in a field of hog raising, since hogsties are required to be heated for a long period of time, the gas heater has been effectively used.

In a gas heater of this type, a heater is ordinarily disposed to ignite gas supplied to a burner of the gas heater, thereby achieving ignition of the gas. However, in a case where flame of the gas is extinguished for some reason, after the ignition, the flame extinction must be detected as soon as possible to interrupt the gas supply for safety. Conventionally, a flame sensor has been adopted as means for detecting the flame extinction. The flame sensor is disposed in the flame so as to sense a change in the resistance value thereof at the time of flame extinction, thereby detecting the condition.

In the gas heater of the prior art, the igniting means and the extinction sensing means are separately disposed, which leads to a problem of an increased number of members disposed in the flame. Moreover, when detecting the flame extinction according to the change in the resistance value, since the resistance value varies between different sensors, there arises a problem that it is impossible to set a fixed temperature for the detection of the flame extinction.

SUMMARY OF THE INVENTION

It is therefor an object of the present invention to provide a gas heater in which the number of members necessary to ignite gas and to sense the extinction of a gas flame is reduced and which minimizes the deviation of the resistance value, the deviation having been a troublesome factor when sensing the flame extinction with conventional devices.

In accordance with the present invention, there is provided a gas heater comprising a ceramic heater, including a support body made of a ceramic material and a resistor formed thereof, the temperature of the ceramic heater being increased when the resistor is powered, thereby igniting gas supplied thereonto, resistance value sensing or detecting means for sensing a resistance value of the ceramic heater disposed in flame formed as a result of ignition of the gas, extinction sensing or detecting means for sensing extinction of the flame based on the resistance value of the ceramic heater produced from the resistance value sensing means, and control means for controlling the respective resistance value and extinction sensing means, the control means controlling the extinction sensing means to sense the flame extinction based on a resistance value of the ceramic heater at a reference temperature.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
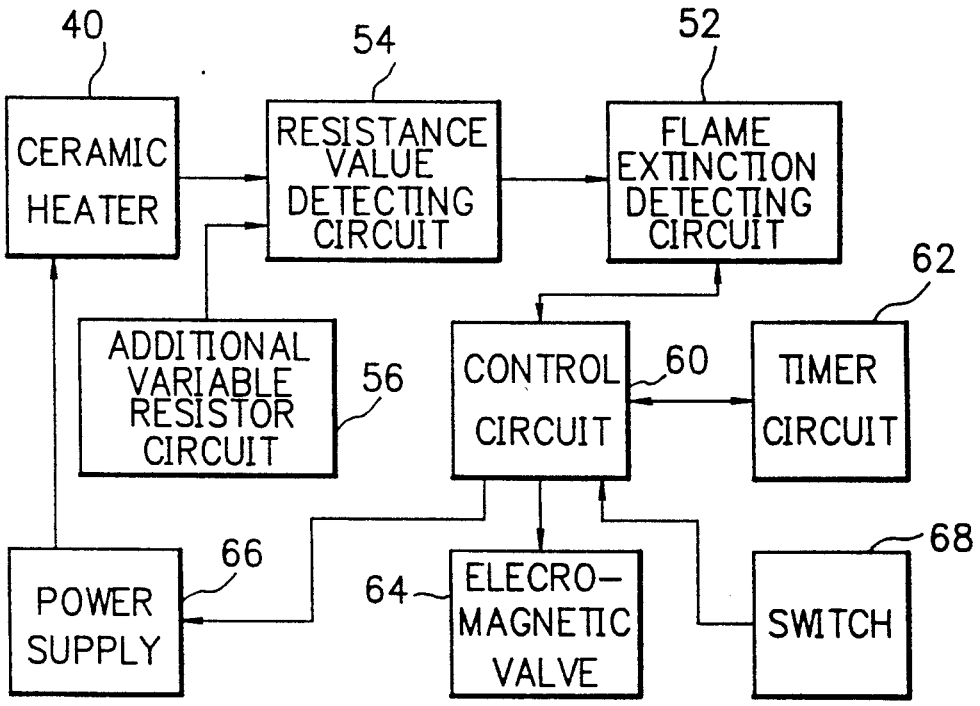
FIG. 1 is a schematic block diagram showing the configuration of an embodiment of a gas heater for use in the stock raising and agriculture in accordance with the present invention.

Referring now to the drawings, a description will be given in detail of a gas heater in accordance with the present invention.

Figure 2:
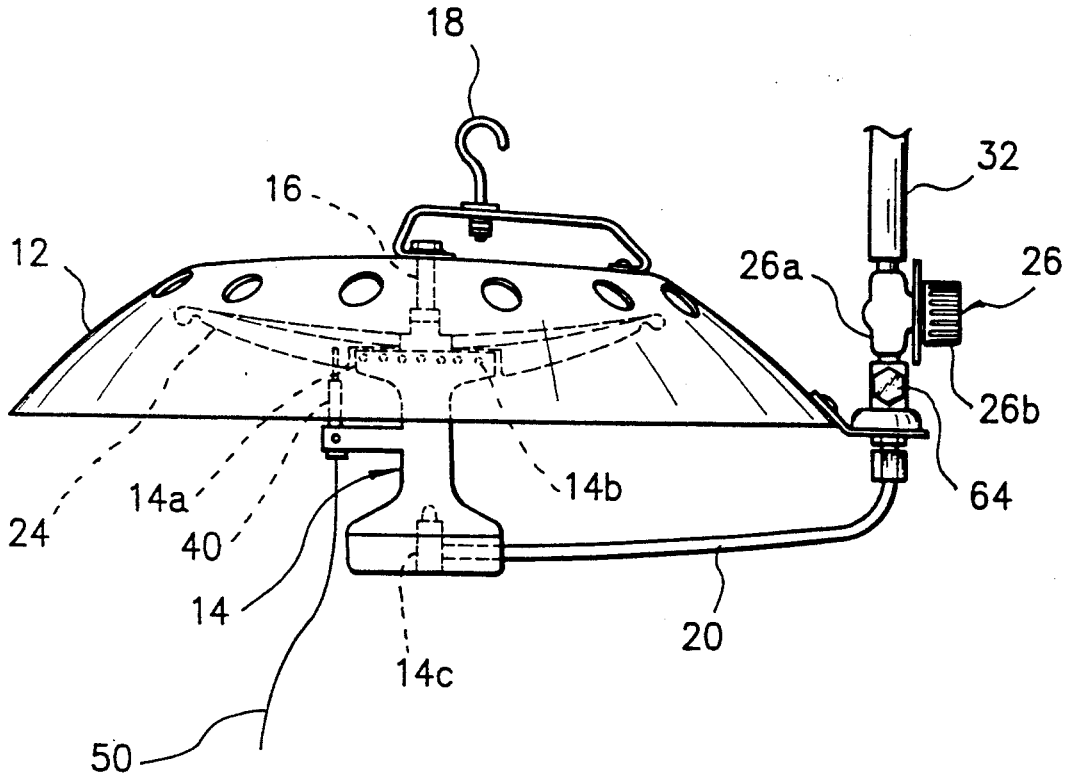
FIG. 2 is a side view showing the mechanical construction of the gas heater of FIG. 1.

FIG. 2 shows a portion of the structure of an embodiment in which the present invention is applied to a gas heater for use in a field of the stock raising and agriculture. As shown in this diagram, the gas heater includes a gas burner 14 at a position inside a reflecting cap or hood 12 in the shape of a lamp shade or a dome. The reflecting hood 12 has a parabolic reflecting surface. The reflecting hood 12 is hung from, for example, the ceiling of a hogsty by use of a hook 18; whereas the gas burner 14 is suspended or attached by a suspending or attaching member 16 from or to a central portion of the reflecting hood 12. The gas burner 14 includes a burner head **14*a* having substantially a cylindrical shape with a large number of flame holes 14*b* disposed in the periphery of the burner head 14*a*. A ceramic heater 40 is disposed in the proximity of the flame holes 14*b***.

Figure 3:
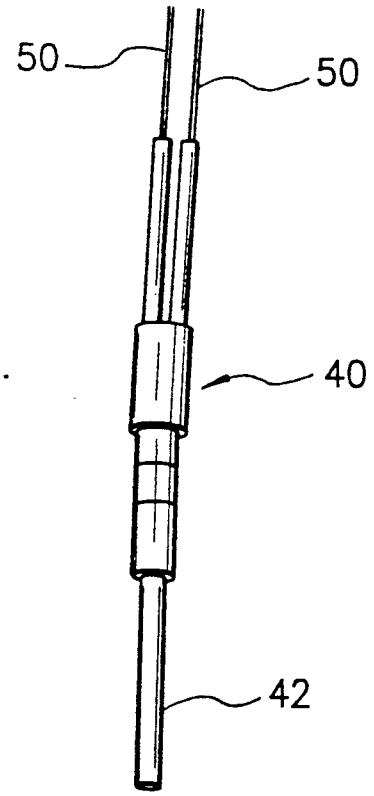
FIG. 3 is a front view showing a ceramic heater employed in the gas heater of FIG. 1.
Figure 4:
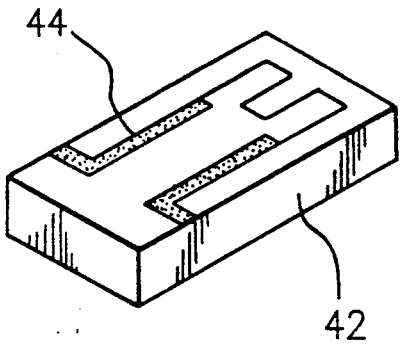
FIG. 4 is a perspective view showing a process of manufacturing the ceramic heater of FIG. 3.
Figure 5:
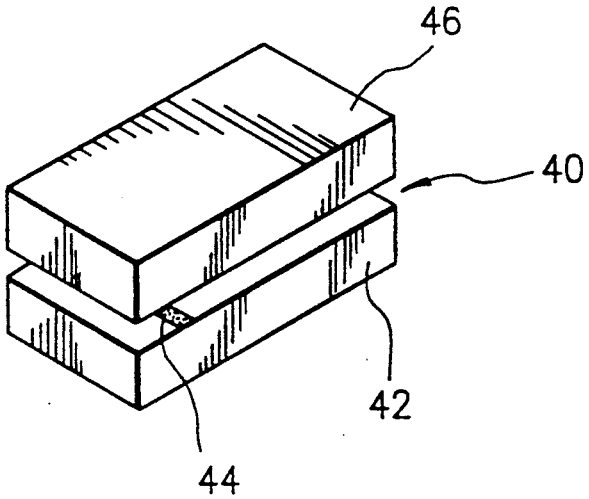
FIG. 5 is a perspective view showing a process of manufacturing the ceramic heater of FIG. 3.
Figure 6:
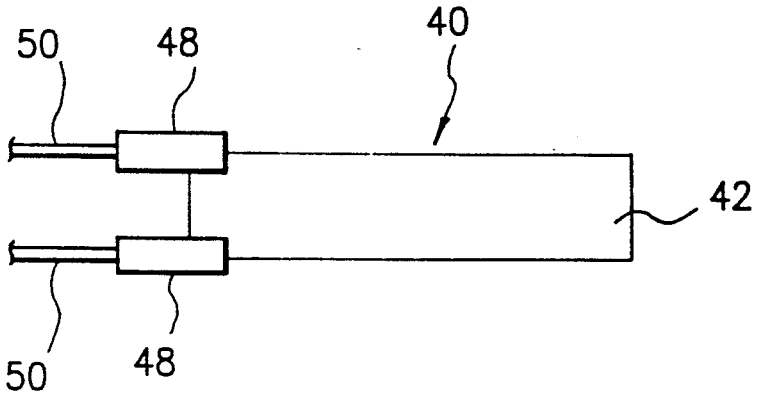
FIG. 6 is a schematic diagram showing the constitution of the ceramic heater of FIG. 3.

The ceramic heater 40 has a contour as illustrated in FIG. 3, and is produced through a manufacturing process as shown in FIG. 4. Namely, a resistor 44 is printed on a ceramic base 42 formed with a silicon nitride $Si_3N_4$ so as to be sintered together with another ceramic plate 46 as shown in FIG. 5. After metalizing the sintered items, power supply wires 50 are connected, via metal members 48, to the resistor 44. As well known, the temperature of the ceramic heater 40 is increased when powered. This heater 40 is hence used as an igniting device thanks to its strength against heat and shock. In this gas heater, the ceramic heater 40 functions as an electrically powered igniting device; moreover, the heater 40 is used as a sensor for sensing extinction of the gas flame. As will be described later, when a predetermined period of time is elapsed after the ceramic heater 40 is powered, the body thereof is heated to a high temperature. Thereafter, fuel gas is supplied to the gas burner 14 to be ignited by the ceramic heater 40. Since the resistance value of the ceramic heater 40 varies with a change in the temperature thereof, the ceramic heater 40 is also adopted as a sensor for detecting a flame extinction. The ceramic heater 40 is disposed in the flame from the flame holes and is kept at a high temperature while so long as the gas is burning. However, at an occurrence of an extinction of the flame, the temperature and accordingly the resistance value are reduced, thereby sensing the flame extinction.

FIG. 1 shows in a block diagram a circuit configuration for igniting gas, and for sensing a flame extinction with the ceramic heater 40. As can be seen from this diagram, the ceramic heater 40 is connected to a resistance value detecting circuit 54, which is in turn connected to an extinction detecting circuit 52. The resistance value detecting circuit 54 is disposed to sense the resistance value of the ceramic heater 40, the resistance value depending on the temperature thereof as described above. The circuit 54 is also connected to an additional variable resistor circuit 56. Since the ceramic heater 40 develops a resistance value at a reference temperature, different from a standard reference resistance value at the reference temperature, this circuit 56 is adopted to correct the deviation of the resistance value. Namely, for the resistance correction, the correcting resistance value of this circuit 56 can take various values. The resistance value established by the additional variable resistor circuit 56 is added to that of the ceramic heater 40 such that the resultant resistance value is sensed by the resistance detecting circuit 54. Based on the obtained resistance value, a flame extinction is detected by the extinction detecting circuit 52.

In the ceramic heater 40, the standard reference resistance is 90 ohms at a reference temperature 25° C. However, for the reference resistance value of the ceramic heater 40, an error of about 10% is allowed in general. Consequently, ceramic heaters having a resistance value, for example, ranging from 81 to 99 ohms at 25° C. have been put on the market. In the heater of this embodiment, when the temperature of the ceramic heater 40 is lowered to 110° C. after ignition of the gas, it is assumed by the extinction detecting circuit 52 that a flame extinction is detected. In a case where the ceramic heater 40 has the reference resistance value above, i.e. a resistance of 90 ohms at 25° C., the resistance value at 110° C. is 105.5 ohms. Consequently, a flame extinction is assumed to have occurred when the resistance value is decreased to 105.5 ohms. However, when the ceramic heater 40 has a reference resistance value (value at 25° C.) different from the standard value described above, the resistance value at 110° C. is also different from the value above. For example, when the ceramic heater 40 has a reference resistance value of 81 ohms at 25° C., the resistance value at 110° C. is 94.9 ohms; moreover, when the resistance value at 25° C. is 99 ohms, the resistance value at 110° C. is 116.0 ohms.

To correct for the deviation of the resistance value, various resistance values are set by the additional variable resistor circuit 56. The additional variable resistor circuit 56 is supplied, as an input thereto, with a resistance value of the ceramic heater 40 at 25° C., from input means not shown. Based on the value, the resistance value is determined by the resistor circuit 56 for the correction. For example, when the resistance value of the ceramic heater 40 employed in the gas heater is 81 ohms at 25° C. this value is inputted from the input means to the resistor circuit 56, which then accordingly sets a difference between the resistance value i.e. $90-81=9$ ohms, thereby sending this resistance difference amount (9 ohms at 25° C.) to the resistance value detecting circuit 54. In the circuit 54, the received value is added to the resistance value of the ceramic heater 40 at 25° C. to detect the resultant resistance value.

The extinction circuit 52 is disposed to detect a flame extinction depending on the corrected resistance value of the ceramic heater 40 sent from the resistance value detecting circuit 54. Namely, in this embodiment, when a condition that the corrected resistance value of the ceramic heater 40 is decreased to 105.5 ohms is detected, it is assumed that the temperature of the ceramic heater 40 is lowered to 110° C., thereby determined that the flame is extinguished.

Moreover, there may be installed, in place of the resistance value detecting circuit 54 and the extinction detecting circuit 52, a circuit which directly detects the flame extinction based on signals supplied from the ceramic heater 40 and the additional variable resistor circuit 56.

The extinction detecting circuit 52 is connected to a control circuit 60, which is connected to a timer circuit 62, an electromagnetic valve 64, a power source 66, and a switch 68. The control circuit 60 controls various sections of the system in response to such signals, to be used for decision of the flame extinction, as an input from the switch 68 and an output from the extinction detecting circuit 52. The control circuit 60 is advantageously configured with a microprocessor. The timer circuit 62 includes a timer for measuring a predetermined period of time. In this ceramic heater 40, particularly, the circuit 62 measures a lapse of time for a control operation to supply power from the power supply to the ceramic heater 40 and to open/close the electromagnetic valve 64. The electromagnetic value 64 is disposed on a nozzle pipe 20 shown in FIG. 2 to control the volume of gas supplied to the gas burner 14, which will be described later. The power supply 66 is connected via the power line 50 to the ceramic heater 40, to supply power to the ceramic heater 40. The switch 68 is disposed for the user to input various instructions to the gas heater, for example, an ignition instruction.

Figure 7:
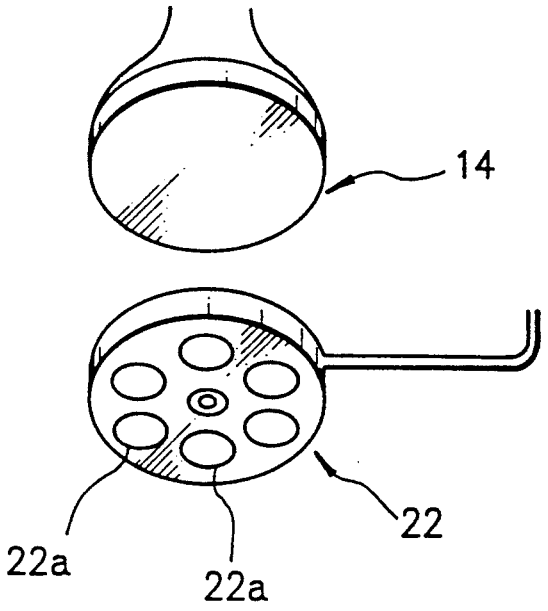
FIG. 7 is a perspective view showing attaching and detaching of an air cap of the gas heater of FIG. 3.

Returning to FIG. 2, a nozzle **14*c* is disposed to face upward at an inner lower position of the gas burner 14. The nozzle 14*c* is coupled with the nozzle pipe 20. On a bottom surface of the gas burner 14, an air cap 22 (FIG. 7), having a predetermined number of air holes 22*a* is engaged. When propane gas delivered via the nozzle pipe 20 is ejected from the nozzle 14*c* into the gas burner 14, the ejected gas is mixed by the gas ejecting force therein with air fed through the air holes 22*a* in the lower portion of the burner 14. The mixed gas is then ejected from the flame holes 14*b*, disposed in the periphery of the burner head 14*a*, to be ignited and to be burned by the ceramic heater 40**.

In the upper portion of the gas burner 14, there is disposed a radiant heat plate 24 having a hollow partial sphere shape enclosing the burner head **14*a*. The plate 24** absorbs the heat energy from the gas flame, to irradiate far infrared rays which are easily absorbed by young pigs or hoglings.

The nozzle pipe 20 is bent upward at a position outside the reflecting hood 12, such that an end portion thereof is coupled with a pipe 32 via the electromagnetic valve 64, and a valve 26 for regulating the flow rate of gas. The electromagnetic valve 64 is opened or closed in response to signals from the control circuit 60 to supply gas to the nozzle pipe 20 or to interrupt the gas supply thereto, respectively. The valve 26 includes a pipe section **26*a* and a dial 26*b* to open/close the valve 26 installed in the pipe section 26*a*, which is detachably attached in an end portion of the nozzle pipe 20. When the dial 26*b* is turned by the operator of the valve 26, the volume of gas fed to the nozzle pipe 20** is changed so that the amount to combustion thereof is set to a predetermined value in a range, for example, 200 to 1800 Kcal/hours. As a result, the operator can set the gas heater to any one of the heating positions for the high, middle, and low heating calorific power levels.

In operation of the gas heater, when the operator inputs an ignition instruction from the switch 68, the instruction is sent to to the control circuit 60, which then outputs a control signal to the power supply 66. The power supply 66 delivers power via the power line 50 to the ceramic heater 40. The temperature of the ceramic heater 40 is thereby increased. When the operation to power the ceramic heater 40 is started, a control signal is delivered from the control circuit 60 to the timer circuit 62. The timer 62 measures a predetermined period of time. When the predetermined period of time, for example, a period of ten seconds, is elapsed, the ceramic heater 40 is heated to a gas ignition temperature, for example, 1000° C. As a result of the measurement, when the time circuit 62 notifies the controller 60 that the 10 seconds has elapsed, the circuit 60 opens the electromagnetic valve 64 to feed gas to the burner 14. Accordingly, gas ejected from the flame holes **14*b* is ignited so as to start the combustion thereof. After the electromagnetic valve 64 is opened to start burning the supplied gas, a control signal is outputted from the control circuit 60 to the timer circuit 62, which starts measuring a predetermined time in resposne thereto. When the predetermined period of time e.g. a period of ten seconds is elapsed i.e. when the timer 62 so notifies the control circuit 60, a control signal is fed from the control circuit 60 to the supply of power 66, thereby stopping power supplied to the ceramic heater 40. The power supplied to the ceramic heater 40 is thus interrupted when the predetermined period of time after the ignition has elapsed, which prevents deterioration of the ceramic heater 40**.

After the ignition, while ordinary fuel combustion is taking place, the flame directly heats the ceramic heater 40. Consequently, the ceramic heater 40 is kept at a high temperature. However, if the flame is extinguished for some reason, for example, by air blown or wind, the ceramic heater 40 is not heated, and hence its temperature is gradually lowered. As already described above, the resistance value detecting circuit 54 detects a resistance value of the ceramic heater 40, the resistance value being corrected by a resistance value received from the additional variable resistor circuit 56. The detected resistance value is fed to the extinction detecting circuit 52. In the extinction detecting circuit 52, when it is detected that the corrected resistance value of the ceramic heater 40 is reduced to, for example, 105.5 ohms, it is assumed that the temperature of the ceramic heater 40 is lowered to 100° C., and that therefore the flame has been extinguished.

When the flame extinction is detected by the extinction detecting circuit 52, the control circuit 60 outputs a control signal to the electromagnetic valve 64 and the power supply 66 in response to a signal from the extinction detecting circuit 52. As a result, the electromagnetic value 64 is closed to immediately stop the gas supplied to the gas burner 14. Thereafter, the power supply 66 starts again supplying power to the ceramic heater 40, thereby heating the ceramic heater 40. As above, when a period of time, for example, a period of ten seconds is elapsed after the power is started to be supplied to the ceramic heater 40, the temperature of the ceramic heater 40 reaches the ignition temperature, for example, 1000° C. Consequently, the electormagnetic value 64 is opened to supply again gas to the gas burner 14.

According to the gas heater of the embodiment above, the ceramic heater 40 is employed as an igniting means and as a flame extinction detecting means. Consequently, in this gas heater, unlike in the conventional apparatus including separate igniting means and flame extinction detecting means, the number of members disposed in the flame can be minimized and hence the structure of the gas heater can be simplified. Moreover, a resistance value is additionally used in consideration of the deviation of the resistance value of the ceramic heater 40 from the reference resistance value, such that the additional resistance value is added to the resistance value inherent to the ceramic heater 40, to detect the flame extinction depending on the measurement of the resultant resistance value. In consequence, the temperature is detected independently of the resistance value of the ceramic heater 40 used in the gas heater so as to correctly detect the flame extinction. Furthermore, at the ignition of gas, the electromagnetic valve 64 is opened when a predetermined period of time is elapsed after the ceramic heater 40 is powered; whereas, upon detection of a flame extinction, the electromagnetic valve is immediately closed and power is supplied to the ceramic heater 40. As a result, ignition of the gas, both initially and after a flame extinction, can be appropriately conducted with safety.

In the embodiment above, there is disposed the additional variable resistor circuit 56 for an addition of a resistance value in consideration of the deviation of the resistance value of the ceramic heater 40 from a standard value, such that the resistance value of the additional variable resistor circuit 56 is set to compensate for the deviation of the resistance value of the ceramic heater 40. However, a resistor having a correction resistance value associated with the actual resistance value, at the reference temperature, of the ceramic heater 40 used in the gas heater, may be installed in the gas heater together with the ceramic heater 40 such that when the ceramic heater 40 employed is replaced, the correction resistance value is also replaced together therewith.

In addition, it may also be possible that a resistance value, at the reference temperature of the ceramic heater 40 used, is input in advance to set a threshold value of a resistor for detecting a flame extinction, such that the resistance value detecting circuit 54 detects the resistance value of the ceramic heater 40 and then the extinction detecting circuit 52 compares the detected value with the threshold value, thereby detecting the flame extinction.

In accordance with the present invention, ceramic heater is adopted as both the igniting means for igniting gas and as a sensor with a resistance value to be heater disposed in the flame to detect the flame extinction, which simplifies the constitution of the gas heater. Moreover, since the flame extinction is detected in consideration of the resistance value of the ceramic heater at the reference temperature, the flame extinction can be correctly detected independently of the deviation of the resistance value of the ceramic heater from a standard value.

While the present invention has been described with reference of the particular illustrative embodiments, it is not to be restricted by those embodiments but only by the appended claims. It is to be appreciated that those skilled int he art can change or modify the embodiments without departing from the scope and spirit of the present invention.

What is claimed is:

1. A gas heater, comprising:

a ceramic heater including a support body formed of a ceramic material and a resistor formed thereon, a temperature of said ceramic heater being increased when said resistor is powered, thereby igniting gas supplied, said ceramic heater having a first resistance value at a reference temperature of said ceramic heater, a resistor means connected to said ceramic heater, said resistor means having a second resistance value correlated to said first resistance value;

resistance value detecting means for detecting and outputting the resistance of said ceramic heater;

extinction detecting means, for detecting a flame extinction according to both the resistance output by said resistance value detecting means and the second resistance value of said resistor means; and control means for controlling said extinction detecting means to detect the flame extinction according to the first resistance value of said ceramic heater.

2. A gas heater in accordance with claim 1, further comprising:

power supply means for supplying power to said ceramic heater;

gas supply control a means for controlling supply of the gas; and timer means, said control means controlling, at an ignition of the gas, said power supply means to power said ceramic heater, controlling, when a lapse of a predetermined period of time is detected by said timer means after the ignition, said gas supply control means to supply the gas, and controlling, when a lapse of another predetermined period of time is detected by said timer means thereafter, said power supply means to stop supplying power to said ceramic heater.

3. A gas heater in accordance with claim 2, wherein said control means controls said gas supply control means to stop supplying the gas when the flame extinction is detected by said extinction detecting means.

4. A gas heater in accordance with claim 2, wherein said control means controls said gas supply control means to stop supplying the gas when the flame extinction is detected by said extinction detecting means and achieves an operation to be conducted at the ignition.

5. A gas heater, comprising:

a ceramic heater including a support body formed of a ceramic material, and a resistor provided on said ceramic material so that by electrically driving said resistor the temperature of said ceramic heater is increased to ignite a gas supplied thereto, said ceramic heater having a heater resistance whose value is dependent upon the temperature of said ceramic heater, the value of said heater resistance, at a reference temperature of said ceramic heater, differing from a standard reference resistance value by a resistance difference amount;

a resistor means, having a resistance value correlated to said resistance difference amount;

resistance value detecting means for detecting the value of said heater resistance of said ceramic heater;

extinction detecting means, for detecting a flame extinction based on the value of the heater resistance detected by said resistance value detecting means, the resistance value of said resistor means, and the value of said heater resistance at the reference temperature of said ceramic heater; and control means for controlling said extinction detecting means to detect the flame extinction.

6. A gas heater according to claim 5, where said resistor means is connected to said ceramic heater so as to be replaceable together with said ceramic heater.

7. A gas heater according to claim 5, wherein said resistance value detecting means detects the resistance value of said resistor means and outputs a signal based on the detected value of the heater resistance of said ceramic heater and the resistance value of said resistor means, said extinction detecting mean receiving the signal output by said resistance value detecting means and detecting the flame extinction based on said signal.

8. A gas heater according to claim 7, wherein said resistance value detecting means determines, and outputs said signal corresponding to, the resistance of a standard ceramic heater whose heater resistance is equal to the standard reference resistance value at the reference temperature.

9. A gas heater according to claim 7, wherein said resistance value detecting means and said extinction detecting means are separate circuits connected to each other.

10. A gas heater according to claim 5, wherein said resistance value detecting means and said extinction detecting means are formed in a single circuit, connected to said ceramic heater and said resistor means, said single circuit detecting a flame extinction based on signals supplied thereto by said ceramic heater and said resistor means.

11. A gas heater according to claim 5, wherein said resistor means comprises a variable resistor circuit connected to said resistance value detecting means, to supply the resistance value of said resistor means to said resistance value detecting means.

12. A gas heater according to claim 5, wherein said resistor means is connected to said ceramic heater so as to be replaceable together with said ceramic heater.

* * * * *